US010285457B2

(12) United States Patent
Roup

(10) Patent No.: US 10,285,457 B2
(45) **Date of Patent: *May 14, 2019**

(54) GARMENT WITH MULTILAYER INTERNAL ABDOMINAL SUPPORT PANELS

(71) Applicant: Talon Technologies, Inc., Woodland Hills, CA (US)

(72) Inventor: Herman Sydney Roup, Santa Barbara, CA (US)

(73) Assignee: TALON TECHNOLOGIES, INC., Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/961,820

(22) Filed: Apr. 24, 2018

(65) Prior Publication Data

US 2018/0235291 A1 Aug. 23, 2018

Related U.S. Application Data

(63) Continuation of application No. 14/882,455, filed on Oct. 14, 2015, now Pat. No. 9,955,741.

(60) Provisional application No. 62/067,949, filed on Oct. 23, 2014.

(51) Int. Cl.

| | |
|---|---|
| ***A41D 1/14*** | (2006.01) |
| ***A41D 27/20*** | (2006.01) |
| ***A41D 1/06*** | (2006.01) |
| ***A41F 9/00*** | (2006.01) |

(52) U.S. Cl.

CPC ..... *A41D 1/067* (2013.01); *A41D 1/14* (2013.01); *A41D 27/20* (2013.01); *A41F 9/00* (2013.01); *A41D 2400/38* (2013.01)

(58) Field of Classification Search

CPC . A41D 1/067; A41D 1/44; A41D 9/00; A41D 1/14; A41D 27/20; A41F 9/00

USPC ..... 2/227, 236, 237, 220, 221, 247–251

See application file for complete search history.

(56) References Cited

U.S. PATENT DOCUMENTS

| | | | |
|---|---|---|---|
| 237,004 | A | 1/1881 | Ferriss |
| 362,565 | A | 5/1887 | Yarwood |
| 472,273 | A | 4/1892 | Rupprecht |
| 514,576 | A | 2/1894 | Walther et al. |
| 759,833 | A | 5/1904 | Stall |

(Continued)

FOREIGN PATENT DOCUMENTS

| | | |
|---|---|---|
| CN | 102984963 | 4/2011 |
| CN | 103181629 | 3/2013 |

(Continued)

OTHER PUBLICATIONS

WIPO, International Search Report for PCT/US2015/055507, dated Mar. 16, 2016 [6 pages, including information on patent family members].

(Continued)

*Primary Examiner* — Gloria M Hale
(74) *Attorney, Agent, or Firm* — Siritzky Law, PLLC

(57) ABSTRACT

Making a control top garment includes forming a pocket bag from a first fused composite material and a second material, the first fused fabric composite having stretch and recovery properties in at least one direction thereof; and attaching the pocket bag to an garment by (i) attaching a first side of the pocket bag to a side of the garment; and (ii) attaching a second side of the pocket bag adjacent a connector of the garment.

40 Claims, 18 Drawing Sheets

(56) References Cited

U.S. PATENT DOCUMENTS 792,097 A 6/1905 White
1,330,364 A 2/1920 Wine
1,883,461 A 10/1932 Baccaro
2,064,724 A 12/1936 Ber
2,116,340 A 5/1938 Chatfield
2,286,889 A 6/1942 Arpin
2,334,311 A 11/1943 Cadous
2,335,971 A 12/1943 Scholle
2,354,669 A 8/1944 Donaldson et al.
2,410,226 A 10/1946 Martin
2,413,141 A * 12/1946 Haggar ..... A41D 27/20 2/252
2,435,377 A * 2/1948 Rothermel ..... A41B 9/02 2/234
2,550,327 A 4/1951 Christensen et al.
2,599,769 A * 6/1952 MacRae ..... A41D 1/08 2/228
2,757,382 A * 8/1956 Whitcomb ..... A41D 27/20 2/247
2,815,023 A * 12/1957 Hammersley ..... A61F 5/24 128/99.1
3,045,245 A * 7/1962 Kohen ..... A41D 1/08 2/227
3,068,871 A * 12/1962 Rapp ..... A41D 1/06 450/95
3,076,201 A * 2/1963 Winter ..... A41F 9/02 2/237
3,127,896 A * 4/1964 Puliafico ..... A41D 1/06 2/227
3,143,741 A * 8/1964 Tyroler ..... A41D 1/06 2/227
3,166,763 A * 1/1965 Wells ..... A41B 13/08 2/112
3,166,764 A * 1/1965 Stedman ..... A41B 9/02 2/403
3,220,017 A * 11/1965 Selby ..... A41D 1/06 2/237
3,234,947 A * 2/1966 Bergstein ..... A41D 1/06 2/237
3,246,342 A * 4/1966 Pagano ..... A41D 1/06 2/227
3,323,140 A * 6/1967 Morris ..... A41D 1/06 2/227
3,422,461 A * 1/1969 Froehlich, Jr. ..... A41F 9/00 2/220
3,425,063 A * 2/1969 Brown ..... A41D 1/08 2/234
3,457,926 A * 7/1969 Bacon ..... A41F 9/02 2/237
3,513,853 A * 5/1970 Marino ..... A41C 1/003 450/104
3,527,222 A * 9/1970 June ..... A61F 5/44 2/231
3,559,213 A * 2/1971 Goodman ..... A41F 9/02 2/221
3,638,242 A * 2/1972 Herter ..... A41D 1/06 2/237
3,678,514 A 7/1972 Safrit
3,723,993 A * 4/1973 Ruby ..... A41D 1/06 2/237
3,751,731 A * 8/1973 Bennett ..... A41D 1/06 2/227
3,763,499 A * 10/1973 Bartos ..... A41D 1/06 2/227
3,848,268 A 11/1974 D'Ambrosio
3,869,728 A * 3/1975 Spencer ..... A41F 9/02 2/221
D234,984 S 4/1975 Gentile
3,987,496 A * 10/1976 Bernard ..... A41F 9/00 2/220
3,996,622 A * 12/1976 Cooke ..... A41D 1/06 2/227
4,069,513 A * 1/1978 Shiller ..... A41D 1/06 2/212
4,332,034 A * 6/1982 Muse ..... A41F 9/02 2/221
D278,376 S 4/1985 Heinfling
4,523,337 A 6/1985 Leibowitz
4,538,615 A * 9/1985 Pundyk ..... A41C 1/003 450/131
D281,636 S 12/1985 Cressy-Renoma
4,637,075 A * 1/1987 Ingrisano ..... A41D 13/0012 2/102
4,649,574 A 3/1987 Michels
4,850,056 A * 7/1989 Gardner ..... A41D 1/08 2/227
4,875,240 A * 10/1989 Barrett ..... A41D 1/06 2/227
4,989,272 A * 2/1991 Wagner ..... A41D 1/06 2/227
5,036,548 A * 8/1991 Grilliot ..... A62B 17/003 182/3
5,052,058 A * 10/1991 Mueller ..... A41B 9/001 2/228
5,157,790 A * 10/1992 Aldridge ..... A41D 13/0525 2/227
5,168,581 A * 12/1992 Garcia ..... A41F 9/02 2/220
5,182,815 A 2/1993 Young
5,219,367 A * 6/1993 Fields ..... A62B 17/001 2/227
D339,220 S 9/1993 Buziol
5,351,340 A * 10/1994 Aldridge ..... A41D 13/0525 2/108
5,373,587 A * 12/1994 Sexton ..... A41F 9/00 2/221
5,447,462 A * 9/1995 Smith ..... A41C 1/003 2/73
5,483,702 A * 1/1996 D'Ambrosio ..... A41F 9/02 2/221
D370,552 S 6/1996 Erwin et al.
5,535,451 A * 7/1996 Tassone ..... A41D 1/06 2/227
5,539,926 A * 7/1996 Mantos ..... A41D 1/08 2/228
5,590,548 A * 1/1997 Osborne ..... A41B 9/04 2/401
5,598,586 A * 2/1997 Munjone ..... A41D 1/08 2/228
5,888,118 A * 3/1999 Kishi ..... A41C 1/003 2/243.1
5,946,725 A * 9/1999 Shatzkin ..... A41D 1/215 2/106
5,978,971 A * 11/1999 Wald ..... A41B 9/02 2/227
6,035,448 A * 3/2000 Thomson ..... A41D 1/06 2/227
6,041,442 A * 3/2000 Owen ..... A41D 1/08 2/227
6,205,591 B1 3/2001 Wheeler et al.
6,311,333 B1 * 11/2001 Batra ..... A41D 1/06 2/221
6,367,086 B1 * 4/2002 Woodard ..... A41D 1/06 2/227
6,543,062 B1 * 4/2003 Amsel ..... A41D 1/06 2/227
6,550,288 B2 * 4/2003 Browder, Jr. ..... D04B 1/243 66/177
D491,712 S 6/2004 Morisset
D511,606 S 11/2005 Caucci
7,341,500 B2 * 3/2008 Horn ..... A41D 1/06 450/122
7,437,774 B2 * 10/2008 Baron ..... A41D 1/04 2/69
D588,782 S 3/2009 Rudes
7,533,243 B2 * 5/2009 Takayama ..... G06F 9/30145 712/24
7,950,069 B2 5/2011 Lee

(56) References Cited

U.S. PATENT DOCUMENTS

| | | | | |
|---|---|---|---|---|
| 8,621,670 | B2 * | 1/2014 | Hansen | A41D 1/06 2/227 |
| 8,959,665 | B1 | 2/2015 | Garner et al. | |
| 9,320,306 | B2 | 4/2016 | Freddi et al. | |
| 9,326,552 | B2 | 5/2016 | Hays et al. | |
| 9,801,420 | B2 | 10/2017 | Hays et al. | |
| 9,955,741 | B2 * | 5/2018 | Roup | A41D 1/067 |
| 2005/0132474 | A1 * | 6/2005 | Amsel | A41D 1/06 2/227 |
| 2005/0198724 | A1 * | 9/2005 | Steitle | A41D 27/08 2/244 |
| 2006/0010571 | A1 | 1/2006 | Oakley | |
| 2007/0118954 | A1 | 5/2007 | Lee | |
| 2007/0136930 | A1 * | 6/2007 | Dipietro | A41D 1/06 2/227 |
| 2008/0189834 | A1 * | 8/2008 | Leung | A41B 9/08 2/406 |
| 2009/0031469 | A1 | 2/2009 | Christensen et al. | |
| 2009/0031470 | A1 * | 2/2009 | Ishikawa | A41D 1/06 2/69 |
| 2009/0083894 | A1 * | 4/2009 | Causey-Gabbe | A41B 9/08 2/78.1 |
| 2009/0106874 | A1 * | 4/2009 | Shlush | A41B 9/023 2/78.1 |
| 2010/0136882 | A1 * | 6/2010 | Malish | A41C 1/06 450/11 |
| 2010/0192284 | A1 * | 8/2010 | Simon | A41D 1/06 2/236 |
| 2010/0299797 | A1 * | 12/2010 | Riehl | A41D 1/22 2/67 |
| 2011/0099677 | A1 * | 5/2011 | Mamiye | A41D 27/02 2/67 |
| 2011/0131705 | A1 * | 6/2011 | Waldman | A41D 1/06 2/221 |
| 2012/0000007 | A1 * | 1/2012 | Hansen | A41D 1/06 2/234 |
| 2012/0117714 | A1 | 5/2012 | Peck et al. | |
| 2012/0129425 | A1 | 5/2012 | Bevans | |
| 2013/0145516 | A1 * | 6/2013 | Zielinski | A41D 1/06 2/69 |
| 2013/0316617 | A1 | 11/2013 | Freddi et al. | |
| 2015/0082516 | A1 | 3/2015 | Doan | |
| 2015/0189921 | A1 | 7/2015 | Callahan | |
| 2015/0237935 | A1 | 8/2015 | Maryea | |
| 2015/0313302 | A1 | 11/2015 | Boyle | |
| 2015/0366270 | A1 * | 12/2015 | Delgado | A41F 9/02 450/95 |

FOREIGN PATENT DOCUMENTS

| | | |
|---|---|---|
| GB | 2356552 | 5/2001 |
| WO | WO 2011/041716 | 7/2013 |

OTHER PUBLICATIONS

WIPO, Written Opinion of the International Searching Authority for PCT/US2015/055507, dated Mar. 16, 2016 [5 pages].

UK Intellectual Property Office, First Examination Report for GB1518216.5, dated Sep. 21, 2017 [3 pgs.].

EPO, Extended European Search Report for EP15852894.3, dated Nov. 22, 2017 [5 pgs.].

Canadian Intellectual Property Office (CIPO), First Office Action for CA 2,957,729, dated Nov. 2, 2017 [4 pgs.].

State Intellectual Property Office of the People's Republic of China (Chinese Patent Office), First Office Action, dated Mar. 6, 2018, for Chinese Patent Application No. 201580051019.1. [including English language translation].

State Intellectual Property Office of the People's Republic of China (Chinese Patent Office), Search Report, dated Mar. 6, 2018, for Chinese Patent Application No. 201580051019.1. [including English language translation].

UK Intellectual Property Office, Second Examination Report for GB1518216.5, dated Jul. 18, 2018 [2 pgs.].

UK Intellectual Property Office, Intention to Grant for GB1518216.5, dated Nov. 1, 2018 [2 pgs.].

EPO, Communication from Examining Division for European application No. 15852894.3; dated Jun. 29, 2018 [5 pgs.].

Canadian Intellectual Property Office (CIPO), Notice of Allowance for CA 2,957,729, dated Jul. 31, 2018.

State Intellectual Property Office of the People's Republic of China (Chinese Patent Office), Second Office Action, dated Jan. 2, 2019, for Chinese Patent Application No. 201580051019.1. [including English language translation].

* cited by examiner

Fig. 3(L)
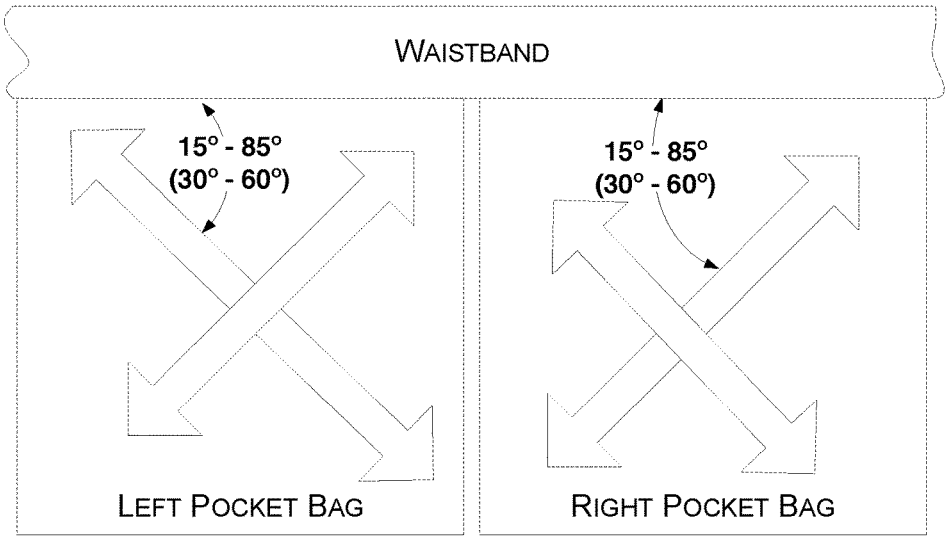
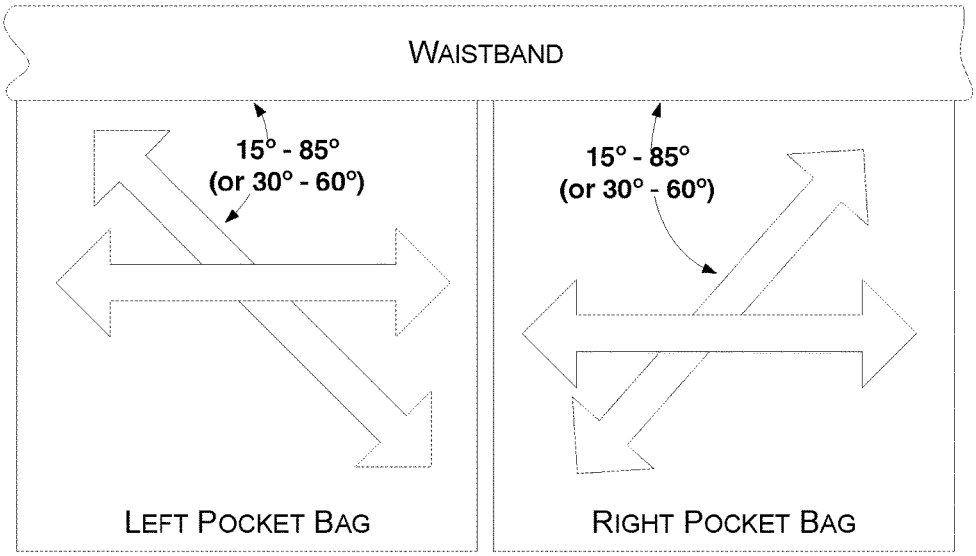
Fig. 3(M)

GARMENT WITH MULTILAYER INTERNAL ABDOMINAL SUPPORT PANELS

RELATED APPLICATIONS

This application is related to and claims priority from co-pending and co-owned U.S. patent application Ser. No. 14/882,455, filed Oct. 14, 2015, issued May 1, 2018 as U.S. Pat. No. 9,955,741, and which claims priority from U.S. Provisional Patent Application No. 62/067,949, filed Oct. 23, 2014, the entire contents of each of which are hereby fully incorporated herein by reference for all purposes.

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

BACKGROUND OF THE INVENTION

Field of the Invention

This invention relates to garment and garment manufacture, and, more particularly to garments incorporating one or more multilayer internal abdominal support panels.

Background and Overview

Many people are unhappy with the way their clothing looks when worn. This is particularly the case for people who feel that their clothing, especially trousers and skirts, do not support their abdominal regions. Numerous attempts have been made to solve this problem, however each of them has its drawbacks.

U.S. Pat. No. 3,751,731 to Bennett describes a garment such as trousers, slacks and shorts including a pair of pockets so constructed and arranged as to provide an abdominal supporting band. FIGS. 1(A) and 1(B) hereof correspond to FIGS. 1 and 2, respectively, of Bennett (with lead lines and reference characters omitted). According to Bennett, one side edge of each pocket is secured to the garment fabric near a conventional fly closure and the other side edge of each pocket is secured to the garment cloth near the side seam of the pocket. The widths of the pockets are made slightly less than the confronting portions of the garment cloth so that the pockets form an abdominal supporting band and the garment cloth is allowed to hang freely from the waistband of the garment. In Bennett, the desired abdominal support is supposed to be obtained by making the pockets slightly narrower than the adjacent portion of the trouser cloth. In Bennett, when the zipper fly is closed, the inner fabric layers of pockets and form a continuous abdominal supporting band extending from one side seam of the trousers to the other side seam thereof. Bennett does not mention what type of fabric to use for the pockets. A problem with Bennett's approach is that once the fabric of the pocket (and the garment) is stretched out its effectiveness is lost. Furthermore, if the fabric is too tight then it will be uncomfortable for the wearer.

Thomson, U.S. Pat. No. 6,035,448 describes a control panel is included in a pair of trousers in order to support and hold the stomach and abdomen. FIG. 1(*c*) hereof corresponds to FIGS. 1 and 2 of Thomson (with lead lines and reference characters omitted).

As described in Thomson, a front edge of the control panel is attached by a line of stitching on the inside of the pants along the length of the zipper, a rear edge of the control panel is attached along the line of stitching in the vicinity of the inseam and the top edge of the control panel is attached along a line of stitching at the waistband. The bottom edge of the control panel is not attached and hangs free. Thomson describes a control panel made of "a girdle like fabric"—made from a fabric consisting of synthetic fibers to provide a greater degree of elasticity in the horizontal direction than in the vertical direction. In further describing her control panel, Thomson states: "The control panel is made of power netting-a girdle fabric with a long stretch of 165 per square ounce and a width stretch of 65 per square ounce. It is a mixture of nylon and spandex synthetic fibers. In the preferred embodiment, the control panel is 14% spandex synthetic fiber spandex with a denier size of 210; nylon with a denier size of 70 makes up the remainder of the material. The degree of stretch is greater in the horizontal plane than in the vertical plane. Any material that is typically used as a control panel in a girdle may be used as the control panel in this invention . . . . The control panel has a plurality of parallel elastomers which are aligned horizontally in the fabric. Thus, the true stretch of the fabric is in the horizontal direction in line with the elastomers. These elastomers correspond to the warp of the knitted material. Connecting the elastomers are a plurality of weft stringers, which are less elastic. Thus, the degree of stretch in the vertical direction is much less than in the horizontal direction. The combination of the horizontally aligned elastomers and the vertically arranged stringers creates a power netting type fabric that is used to control and hold the stomach when the garment is worn." However, it should be appreciated that in use (i.e., when the garment is worn) the support fabric is typically in direct contact with the wearers skin. Accordingly, the use of girdle fabrics, especially a power netting fabric or a spandex synthetic fiber fabric tends to become extremely hot and uncomfortable. Power netting fabrics were previously used in bathing suits, where overheating may be dissipated by the wearer, e.g., by swimming. But the use of such fabrics in a garment such as a skirt or trousers does not offer the opportunity for heat dissipation.

U.S. Patent Publication 2010/0192284 to Simon describes the use of pocket bags that span from the outer seams of pants to the zipper, in order to create an improved silhouette for a wearer of the garment. FIG. 1(D) hereof corresponds to FIG. 3 of Simon (with lead lines and reference characters omitted).

In Simon, elastic panels that also span from the outer seams to the zipper may be included. According to Simon, the pocket bags may "comprise an elastic material" or cotton. Simon specifically defines the term "elastic" as used in his patent application. As used by Simon, "[t]he term "elastic" means any type of material that may be stretched in at least one dimension to a size at least 5% larger than its starting state and as high as 30% larger by the imposition of a mechanical force and that will have a recovery that enables it to return to its original size or to substantially its original size (i.e., to between about 100% and about 105% or between about 100% and about 103% of the original size) if the mechanical force is removed. Examples of elastic materials include but are not limited to mesh materials, and as persons of ordinary skill know it may, for example, be formed by weaving together flexible materials such as flexible yarns. One non-limiting example of the fabric content of the mesh is between about 70% and about 80% nylon, e.g., 78% nylon and between about 20% and about 30% spandex, e.g., about 22% spandex. In other embodiments, stretch denim, which is comprised of denim and lycra [sic] may be used. The aforementioned exemplary materials may be used to form the pocket bags and/or elastic panels." Simon ¶0019. It should be appreciated that Simon's definition of the term "elastic" is reproduced here merely to aid in the understanding of Simon's disclosure, and is not adopted by the applicant.

In describing his pocket bag's in greater detail, Simon says: "[i]n some embodiments, each pocket bag is formed from an elastic material that has the capacity to stretch to a size of at least 5% greater than its resting state in at least one dimension. In some embodiments, each pocket bag can stretch to a size of at least 10% greater than its resting state in at least one dimension. In some embodiments, each pocket bag can stretch to a size of at least 20% greater than its resting state in at least one dimension. In some embodiments, each pocket bag can stretch from about 5% to about 30% along the portion of the bag that spans from the respective outer seam to the fastening system. In some embodiments, each pocket bag may stretch from about 10% to about 25% along the dimension that spans along the portion of the bag that spans from the respective outer seam to the fastening system. In some embodiments each pocket bag may stretch from about 15% to about 20% along the dimension that spans from the respective outer seam to the fastening system. This dimension may also be referred to as the width of the pocket bag." Simon ¶0033. "The cavity of a pocket bag may, for example, be formed from the association of two pieces of material, e.g., cotton; denim; a combination of cotton and nylon; a combination of cotton and polyester; a combination of cotton, nylon and polyester; polyester; nylon; a combination of polyester and nylon; spandex; spandex and nylon. In some embodiments, both pieces of material comprise an elastic material or one piece of material in each pocket bag comprises and elastic material, e.g., the piece of material closer to the body of the wearer of the pants. Additionally, in some embodiments the composition of these materials is uniform and consists only of one or more of the aforementioned materials or combinations of materials." Simon ¶0034.

Simon further says: "the pocket bags may be made of a material is stretchable or elastic. It is important to note that most materials that are used in clothing have some degree of stretchability. However, unless otherwise specified, the pocket bags of the present invention has an elasticity that enable them to be stretched from about 5% to about 30% or from about 10% to about 25% or from about 10% to about 20% or from about 15% to about 20% along the dimension that spans from the respective outer seam to the fastening system. In some embodiments the elastic panels and the pocket bag have the aforementioned elasticity properties and the elastic panels and the pocket bags have either the same or different degrees of elasticity. In some embodiments, the elastic panels have the aforementioned elasticity properties, but the pockets bags are not elastic. In some embodiments, both the pocket bags and the elastic panels have a degree of elasticity but the elastic panels have a greater degree of elasticity. In some embodiments, both the pocket bags and the elastic panels have a degree of elasticity but the elastic panels have a smaller degree of elasticity." Simon ¶0058.

Additionally, in some embodiments of Simon, "the pocket bags and/or elastic panels are comprised of two-way stretch material, meaning that they stretch only along their widths (i.e., from the outer seam to the fastening system). In other embodiments the pocket bags and/or elastic panels are comprised of elastic materials that may stretch in both height directions (i.e. from the waist band to the bottom edge) and in both width directions and thus are know as four-way stretch materials." Simon ¶0059.

Simon's use of multilayers of fabric and a pocket bag adds bulk to the garment.

U.K. Patent GB 2356552, titled "Outer garment with integral support means," filed, to Hales describes an outer garment such as trousers or skirt the like with an integral support means. FIGS. 1(E) and 1(F) hereof correspond to FIGS. 1 and 2 of Hales, respectively (with lead lines and reference characters omitted). In Hales the support means goes around the entire body, so that a portion is in the front and a portion is at the rear of the garment. Hales' support means may be a lining and may be attached at the garment at the waistband. In Hales the lining may be further attached to the outer garment at the back and/or side seams of the outer garment. There may be further attachment at the crotch, where present. In Hales the lining material is described as: "comprising a resilient mesh fabric with a section comprising one or more layers of stiffer resilient fabric, said section being positioned to lie over the lower abdomen of the wearer in use." Hale, pg. 1, lines 17-19. The whole lining may be formed from a resilient mesh fabric. Hale, pg. 1, lines 21-22. The resilient mesh fabric is preferably a powernet knit or weave, with various mix ratios mentioned by Hale. Hale, pg. 1, lines 24-27. The mesh fabric may be a polyamide/elastane blend such as LYCRASOFT. Hale, pg. 1, line 29.

Other attempts to providing abdominal support for a wearer of an outer garment include various forms and patterns of stitching across the pockets or inner fabric of the garment. For example, U.S. Design Pat. No. D588,782 to Rudes shows a design of an "X" stitched across the pocket (it being understood that a design patent does not protect any functionality). The "X" stitch is meant to give the cotton pocketing some strength to try to stop the cotton from stretching out by means of a chain stitch. However, this approach still allows the pocket to stretch out while not being strong enough to give the fabric recovery. FIG. 1(G) hereof corresponds to FIG. 2 of Rudes. The applicant is aware of a product sold under the name "Not Your Daughter's Jeans" (NYDJ) which has a stitch pattern similar to that shown in Rudes (D588,782). FIG. 1(H) is a picture of the inside of a pair of jeans sold under the brand name "NYDJ."

U.S. Pat. No. 8,621,670 to Hansen describes a pair of trousers in which an inner part includes at least two stitchings extending from a first side seam towards the front seam, and at least two stitchings extending from a second side seam towards the front seam which follow the shape of an abdomen of a person wearing the trousers to thereby support the abdomen. FIG. 1(I) hereof corresponds to FIG. 1 of Hansen (with lead lines and reference characters omitted).

U.S. Pat. No. 8,418,268 to Waldman describes a garment including a body of fabric having a waistband and at least two seams that extend from the waistband and a support structure that is connected to the at least two seams and the waistband is provided. FIG. 1(J) hereof corresponds to FIG. 1 of Waldman (with lead lines and reference characters omitted). The support structure further includes a pocket and a tape connected to the pocket that prevents elongation of the support structure between said at least two seams during the wearable life of the body of fabric. However, again there is no recovery provided by the tape.

The applicant is also aware of a product sold by Levi Strauss & Co. under the name "512 Perfectly Slimming Jeans." This product is described on the Levi's web page as "This pair of jeans holds a figure-enhancing secret: A tummy slimming panel through our innovative pocket design that creates an all over smooth shape, with super-stretchy denim that ensures all-day comfort." The web page further states, under the heading "Overview," that the pants have: a "Tummy-slimming panel," "Stretch fabric," and "77% cotton, 21% polyester, 2% Elastane." FIG. 1(K) is a picture of the inside of a pair of these 512 "Perfectly Slimming" jeans. As shown in the picture, a pocket bag is connected to the waistband at the top, to the zipper panel on one side and to the leg on the other side. The bottom of the pocket bag is not connected to the outer garment.

An object of this invention is to provide an outer garment having internal abdominal support provided without the heat or discomfort of prior systems while maintaining shape or form control and recovery.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE PRESENTLY PREFERRED EXEMPLARY EMBODIMENTS

Figure 1A:
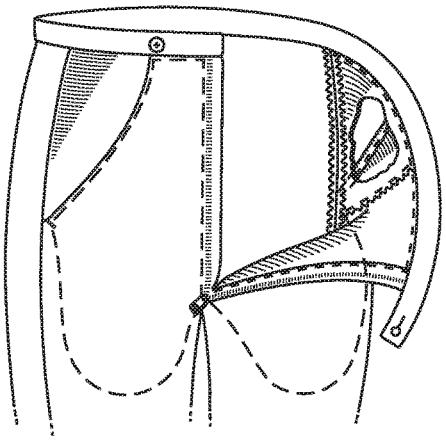
FIG. 1(A) (PRIOR ART)
FIGS. 1(A)-1(G) and 1(I)-1(J) are figures from prior art patents of known trousers incorporating some form of abdomen control (the label numbers in these prior art figures are the numbers used in the various prior art applications, and they are not used herein)
Figure 1B:
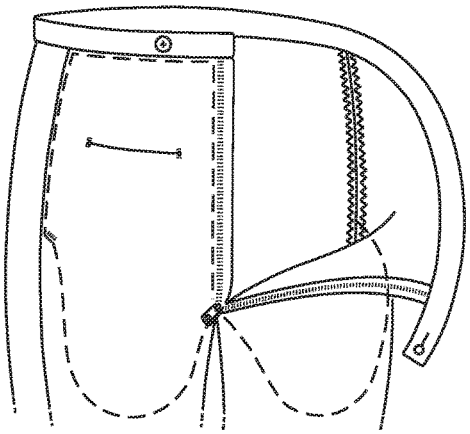
FIG. 1(B) (PRIOR ART)
Figure 1C:
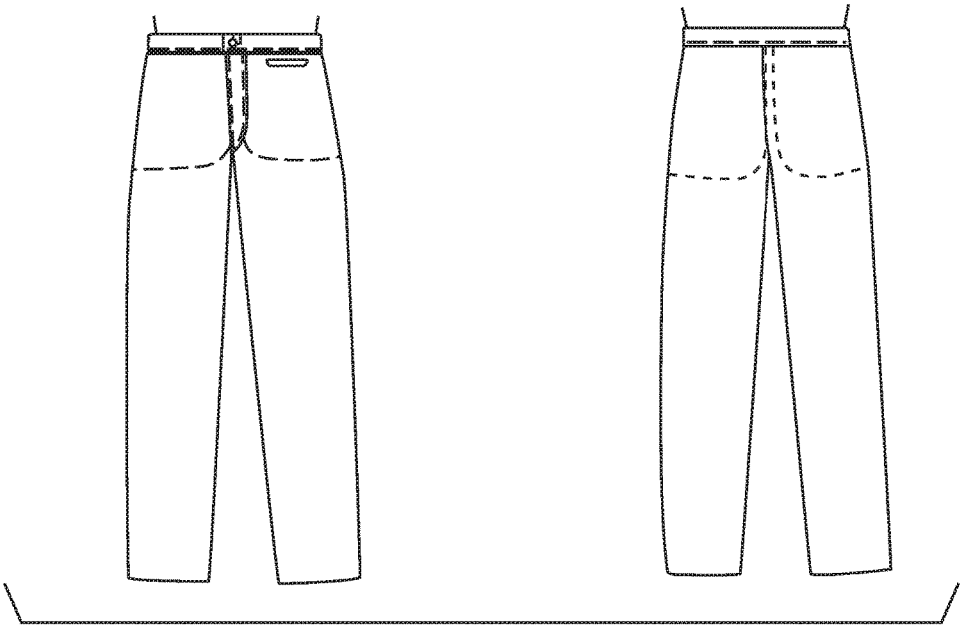
FIG. 1(C) (PRIOR ART)
Figure 1D:
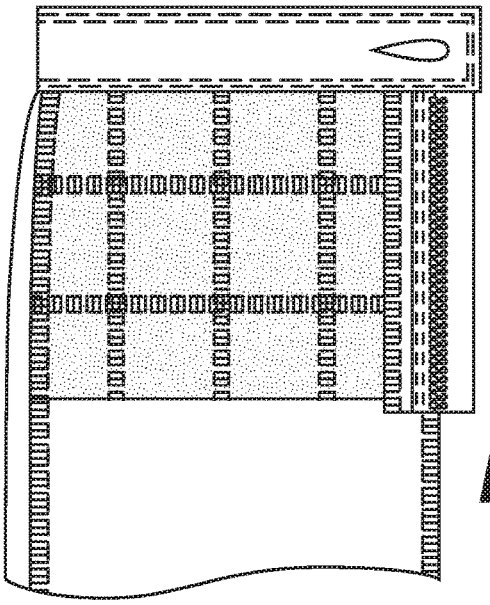
FIG. 1(D) (PRIOR ART)
Figure 1E:
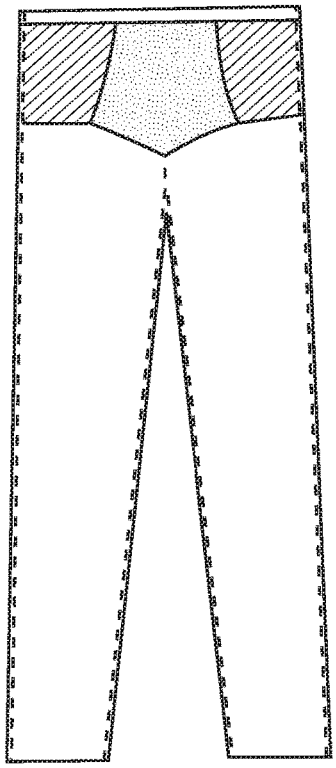
FIG. 1(E) (PRIOR ART)
Figure 1F:
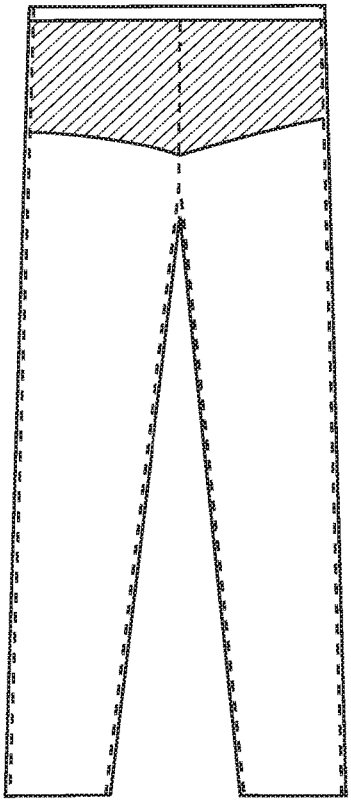
FIG. 1(F) (PRIOR ART)
Figure 1G:
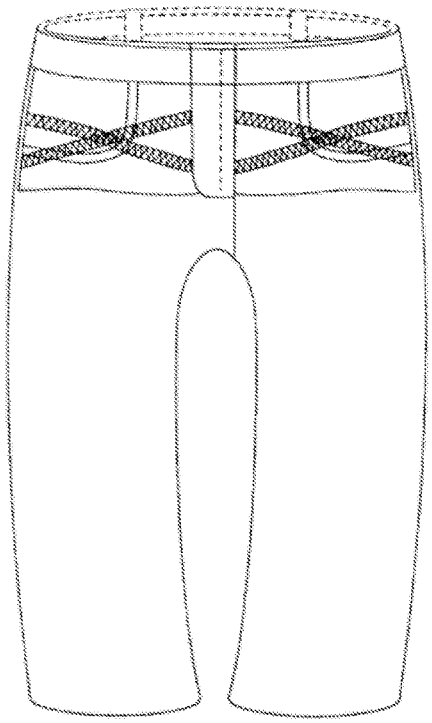
FIG. 1(G) (PRIOR ART)
Figure 1H:
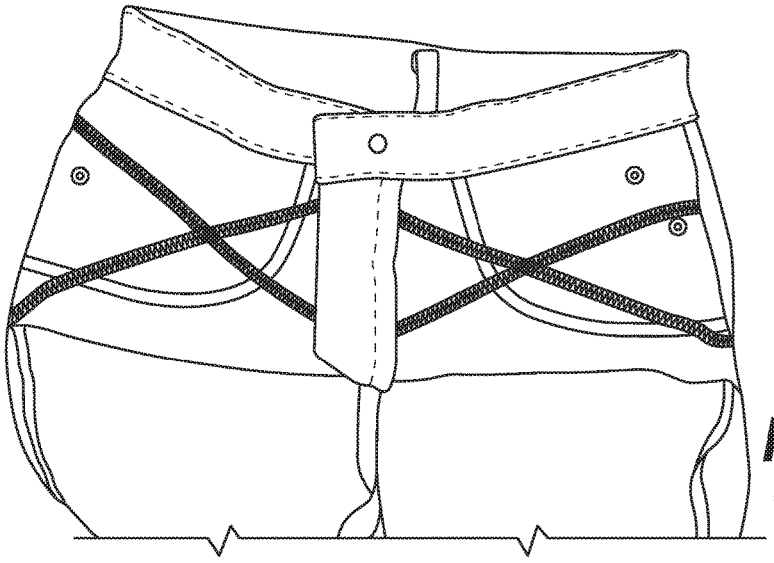
FIG. 1(H) (PRIOR ART)
FIGS. 1(H) and 1(K) are pictures of existing products incorporating some form of abdomen control.
Figure 1I:
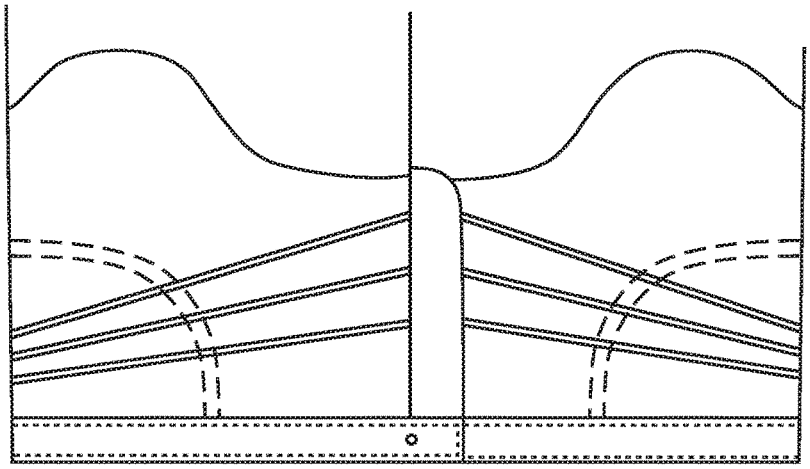
FIG. 1(I) (PRIOR ART)
Figure 1J:
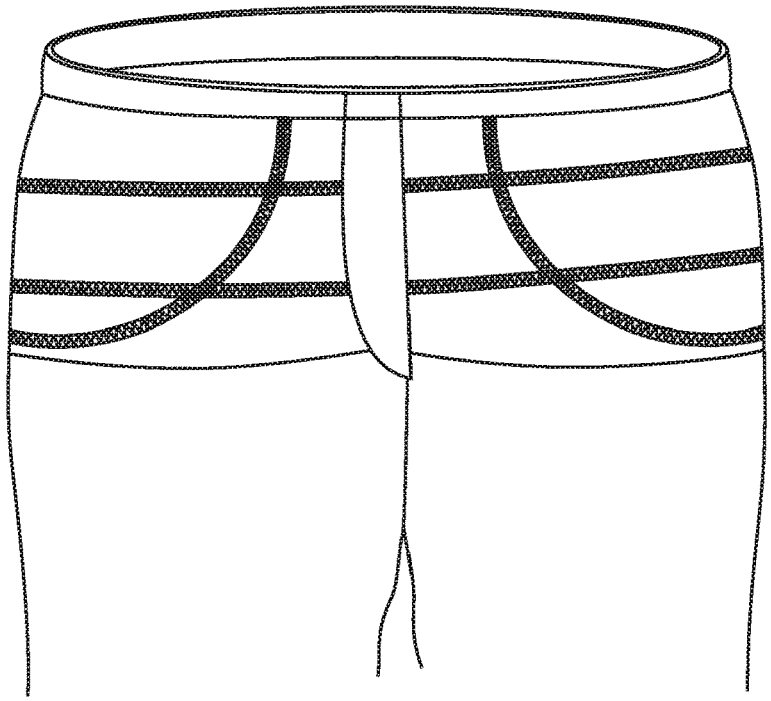
FIG. 1(J) (PRIOR ART)
Figure 1K:
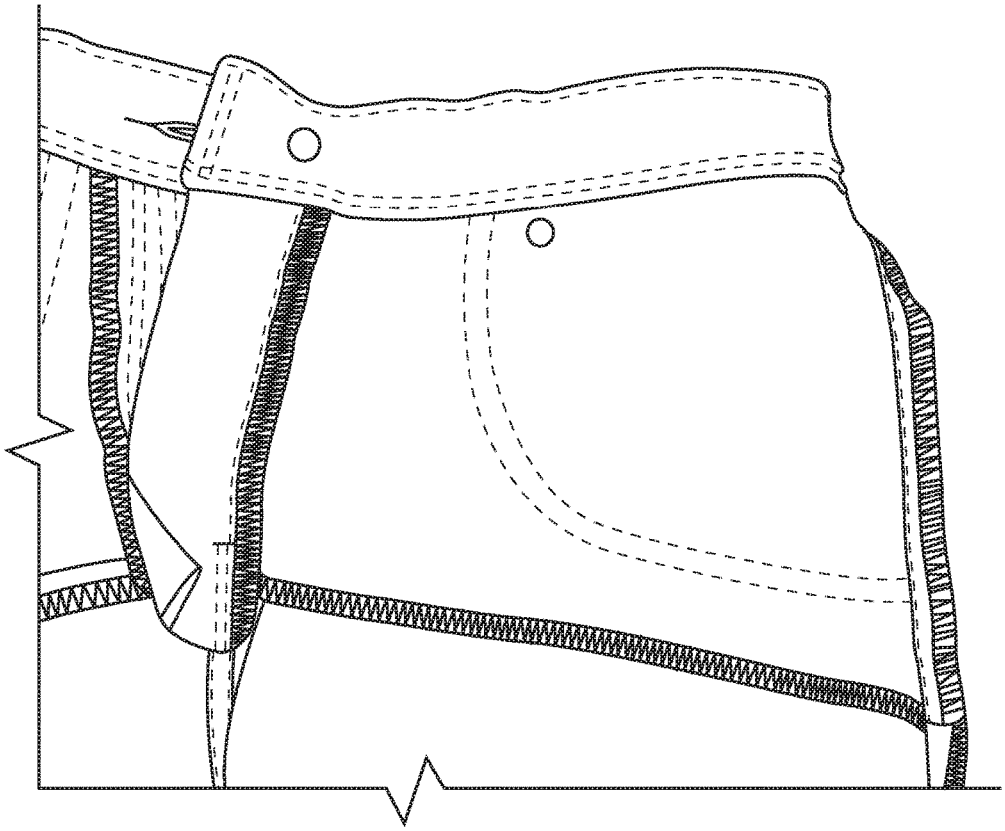
FIG. 1(K) (PRIOR ART)
Figure 2A:
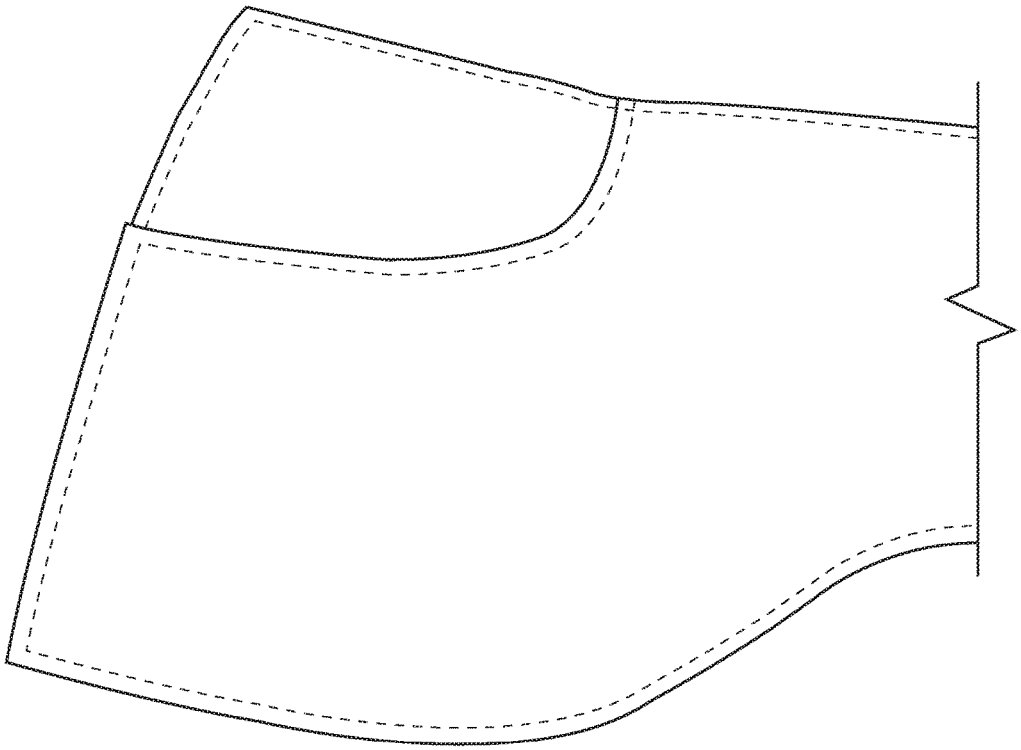
FIGS. 2(A)-2(B) show an abdomen control pocket according to exemplary embodiments hereof.
Figure 2B:
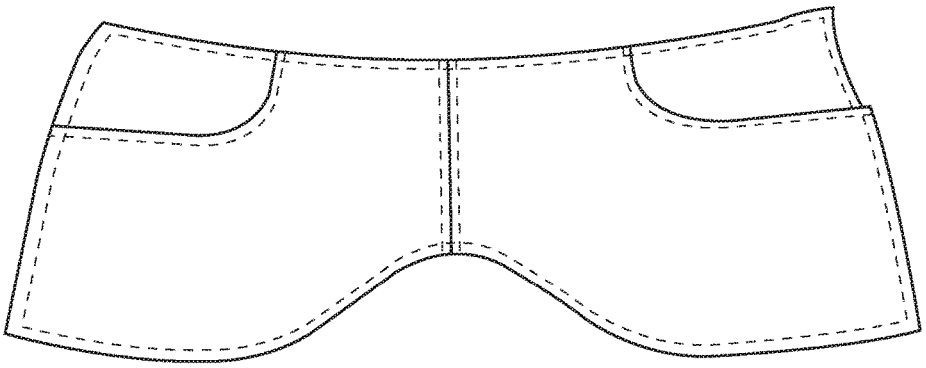

FIG. 2(A) shows an abdomen control pocket according to exemplary embodiments hereof. The control pocket will be attached to an outer garment such as a pair of trousers, a skirt or the like, as described below. As shown in FIGS. 2(A) and 2(B), a control pocket is formed from a front or outer piece and a back or inner piece. The front piece will, in use, face the outer garment to which the pocket is attached. The back piece will, in use, face the wearer of the garment to which the pocket is attached. The front and back pieces may be sewn or otherwise connected to form a pocket bag. A top edge portion of the pocket bag is connected to a waistband of the outer garment using a known connection technique (e.g., some form of stitching). Once side edge portion of the pocket bag is connected to the a front zipper or front fly portion of the outer garment, also using a known connection technique (e.g., some form of stitching), and the other side edge portion of the pocket bag is connected to the leg or side portion of the outer garment. The lower edge of the pocket bag is preferably not connected to the outer garment and is allowed to hang/move freely. One pocket bag is connected to a left front side of the outer garment and another pocket bag is connected to a right front side of the outer garment.

If the outer garment does not have a front fly or zipper portion (e.g., it has a rear zipper or no zipper or fly) then the left and right pocket bags may be combined into one piece and connected at the top, along the waistband, and at the outside edges. A similar connection may be used when the outer garment is a skirt or is a garment with no crotch portion.

Figure 2C:
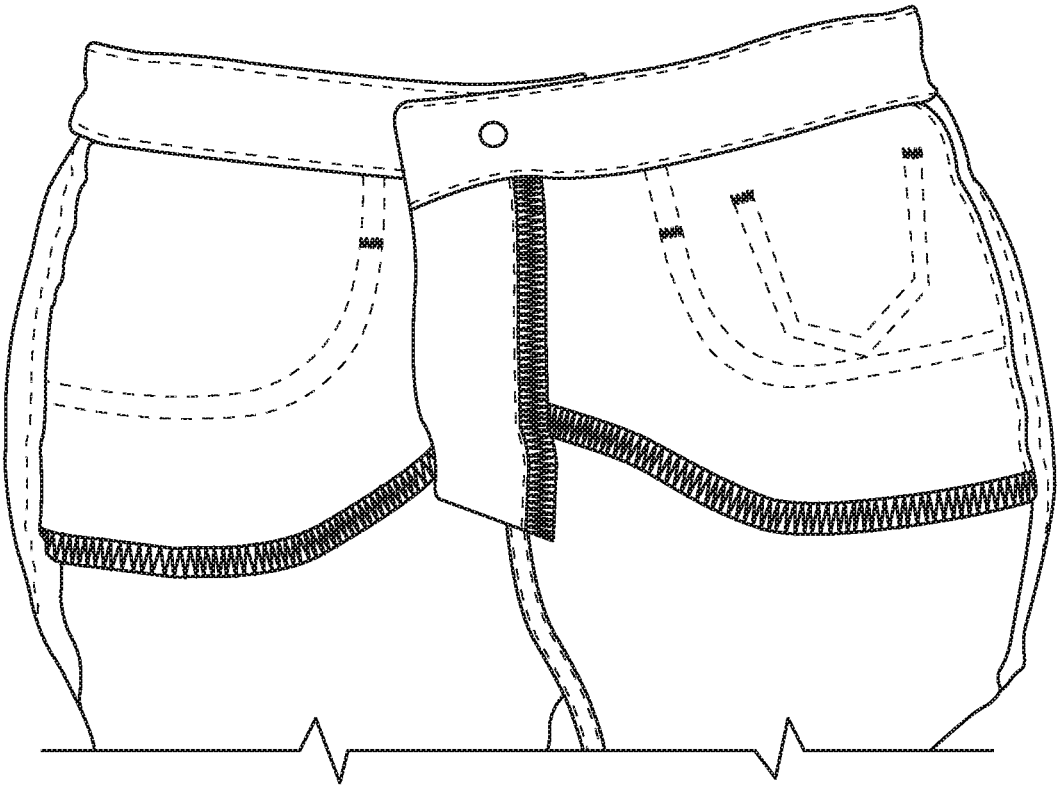
FIG. 2(C) shows abdomen control pockets attached to a pair of trousers according to exemplary embodiments hereof.
Figure 2D:
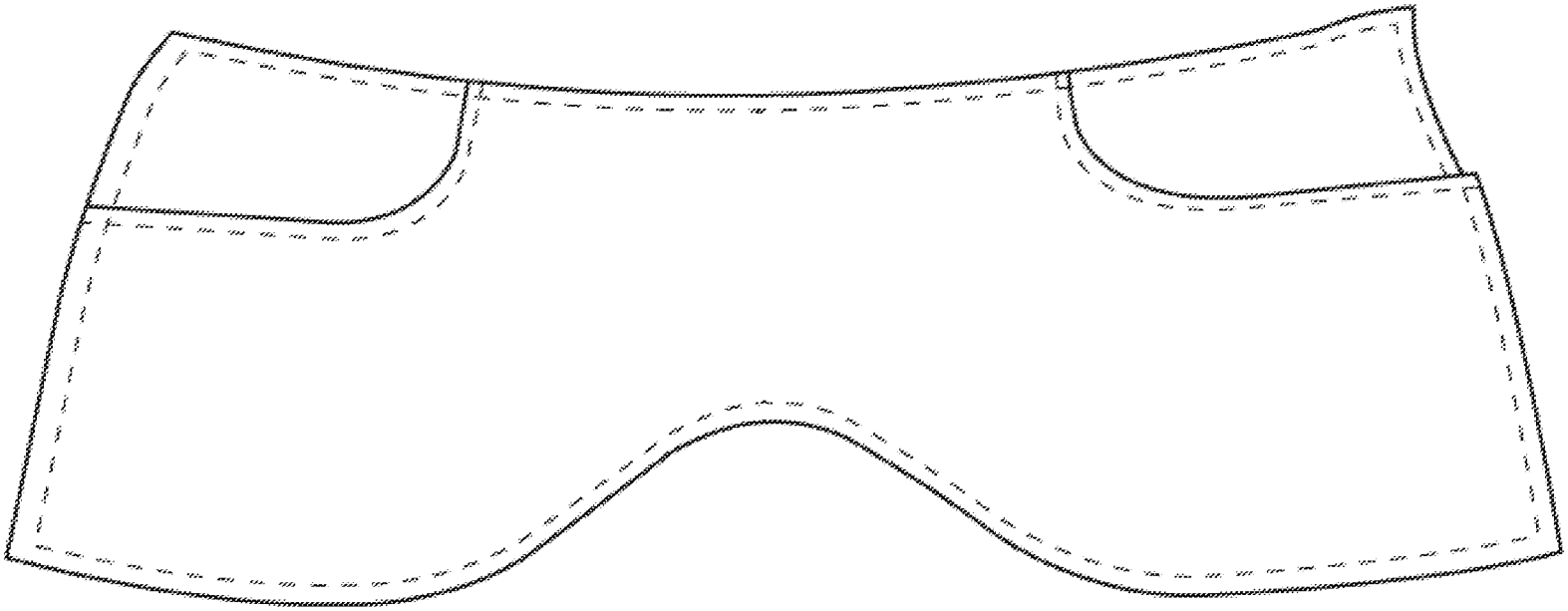
FIG. 2(D) shows abdomen control pockets according to exemplary embodiments hereof.
Figure 2E:
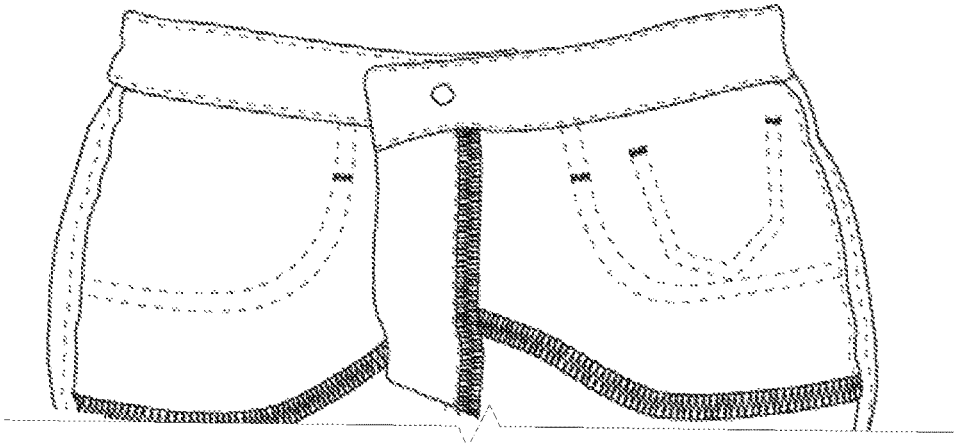
FIG. 2(E) shows abdomen control pockets attached to a skirt according to exemplary embodiments hereof.

FIG. 2(C) shows two pocket bags connected to a pair of trousers according to exemplary embodiments hereof. FIG. 2(E) shows abdomen control pockets attached to a skirt according to exemplary embodiments hereof.

As noted, the pocket bag according to exemplary embodiments hereof is formed of an inner piece and an outer piece. These pieces should be sized such that they form a snug fit against the wearer when in use.

Figure 2F:
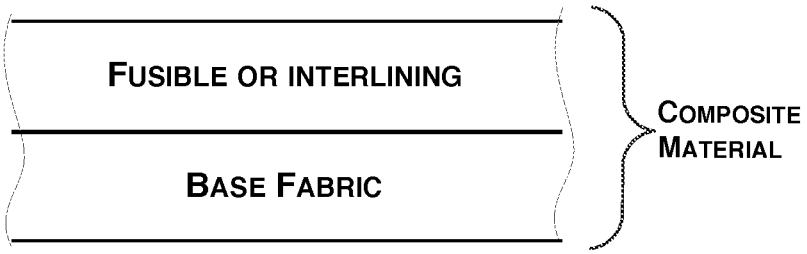
FIG. 2(F) shows a composite material according to exemplary embodiments hereof.

One of both of these pieces comprises a fused fabric composite formed from a fabric having a fusible material attached thereto (e.g., as in FIG. 2(F)). The fusible material (or interlining) may be applied to the fabric in any way, although it is preferably applied to the fabric by a technique that imposes or imparts stretch and recovery properties on the composite fused fabric in at least one direction thereof, such that the fused fabric composite will maintain the stretch and recovery properties imparted to the fabric. Those of ordinary skill in the art will realize and appreciate, upon reading this description, that any technique may be used to form the fused fabric composite with the desired stretch and recovery properties. A non-limiting example of such a technique is described in U.S. Pat. No. 5,987,721, titled, "Imparting stretch to fabrics," the entire contents of which are hereby fully incorporated herein by reference for all purposes.

In some cases the inner and/or outer portions of the pocket bags may be formed using a fused fabric composite may have stretch and recovery properties imparted on two directions. Those of ordinary skill in the art will realize and appreciate, upon reading this description, that any technique may be used to form the fused fabric composite with these desired stretch and recovery properties in two directions. A non-limiting example of a technique for imparting such stretch and recovery properties in two directions is as follows: first a fabric is provided having stretch characteristics in one direction (e.g., a width direction). Heat and pressure are then applied to the fabric by passing the fabric into a nip between a heated roller and a sleeve. This forces the strands across the width of the fabric closer together thus imparting stretch into the fabric in the length direction.

FIGS. 3(A)-3(G) show aspects of abdomen control pockets according to exemplary embodiments hereof.

Figure 3A:
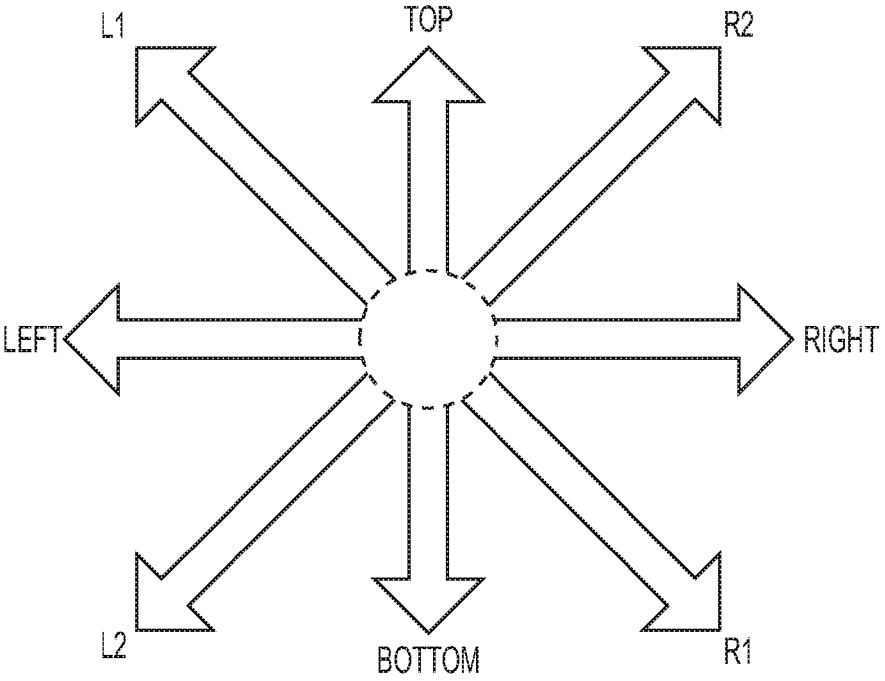
FIGS. 3(A)-3(N) show aspects of abdomen control pockets according to exemplary embodiments hereof.
Figure 3B:
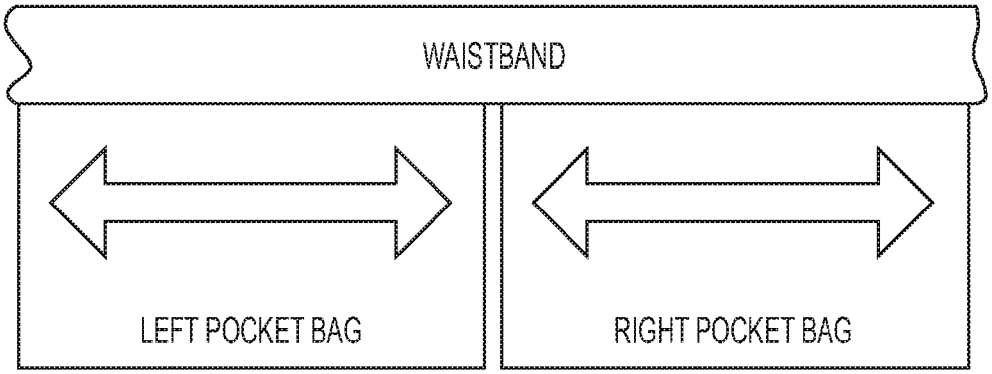
Figure 3C:
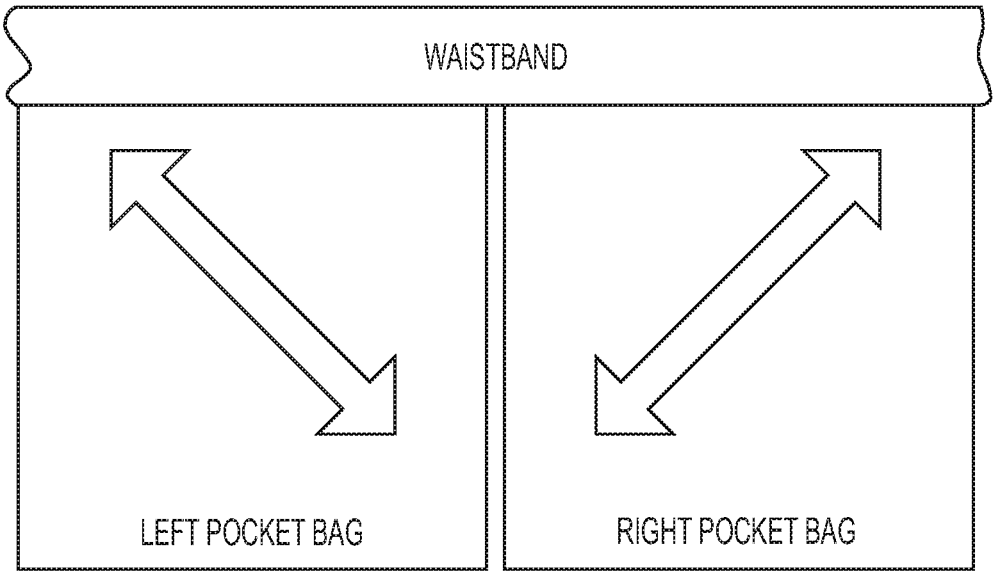
Figure 3D:
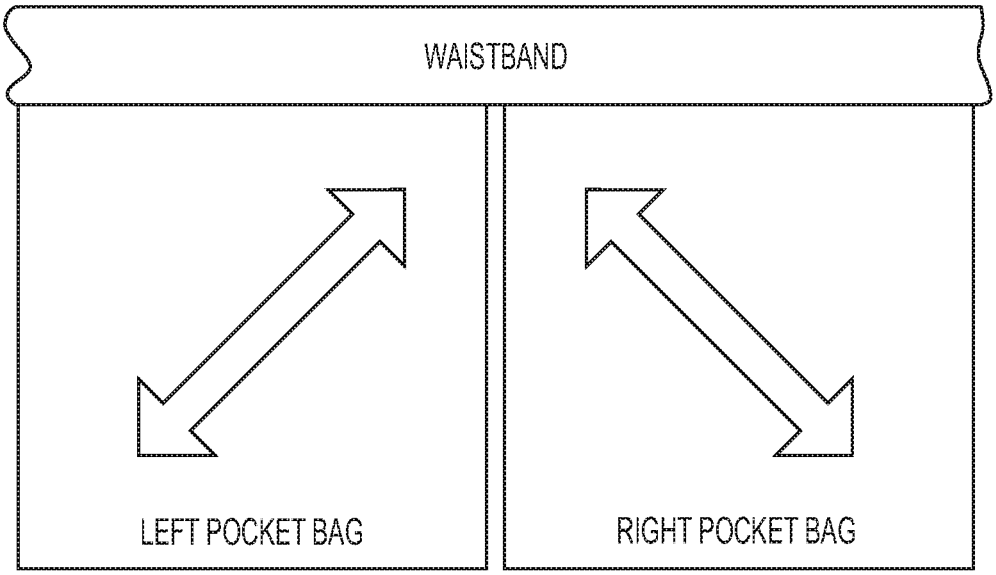

When a fused fabric composite having a one-directional stretch and recovery is used, the pocket bag is preferably formed so that when attached to the outer garment the stretch will be substantially in the left-to-right direction across the front of the outer garment, substantially parallel to the waistband of the outer garment (as shown, e.g., in FIG. 3(A)). In some cases the pocket bag may be formed so that when attached to the outer garment the stretch will be at a non-zero angle to the waistband of the outer garment (e.g., at an angle of between about 15° and 85°, preferably between about 30° and 60°). When the stretch and recovery is not parallel to the waistband, as shown in FIGS. 3(C) and 3(D) the angles of the left and right pockets would preferably be complementary to each other.

When a fused fabric composite having stretch in two directions is used, the pocket bag is preferably formed so that, when attached to the outer garment, at least one of the stretch directions will be substantially parallel to the waistband of the outer garment.

Figure 3E:
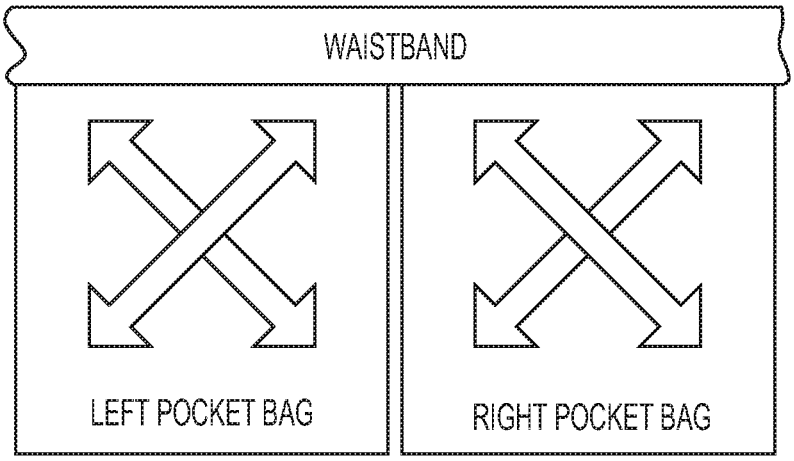
Figure 3F:
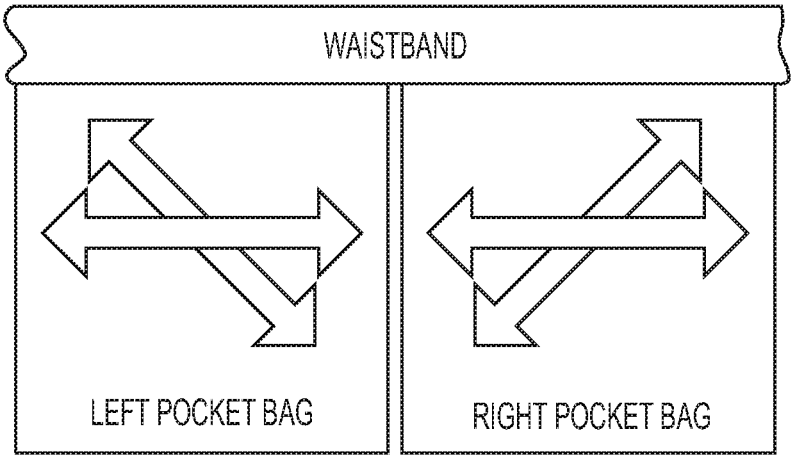
Figure 3G:
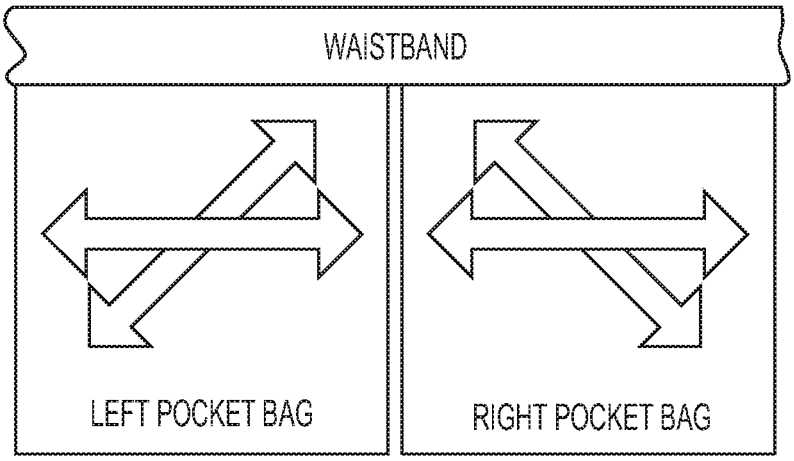
Figure 3H:
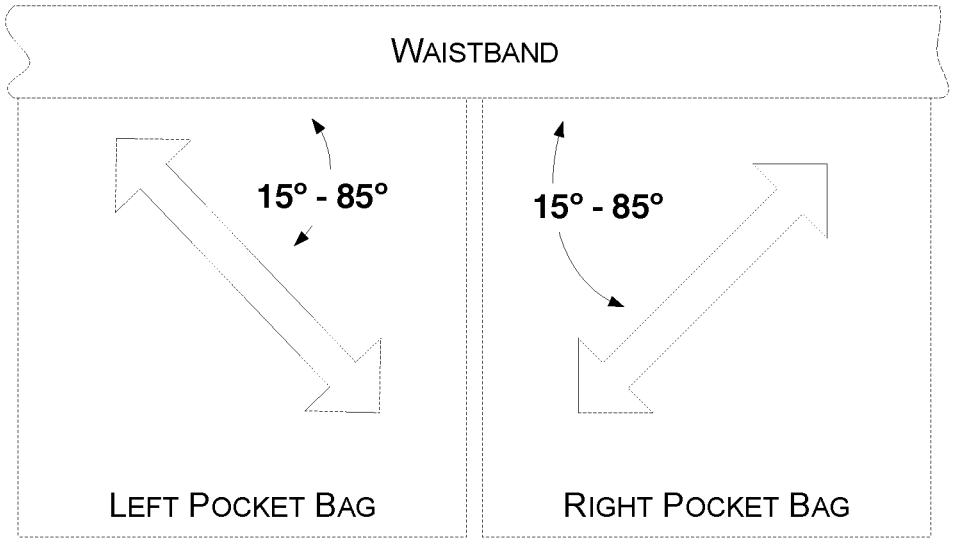
Figure 3I:
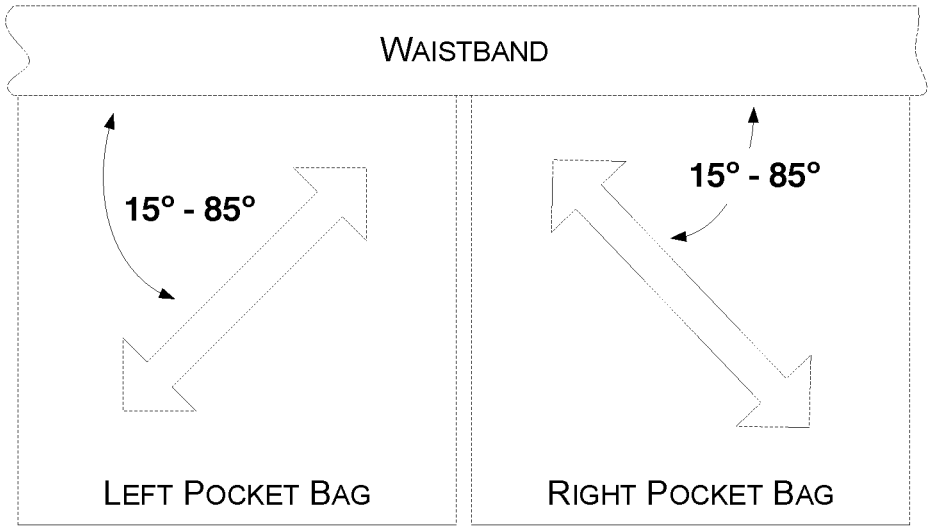
Figure 3J:
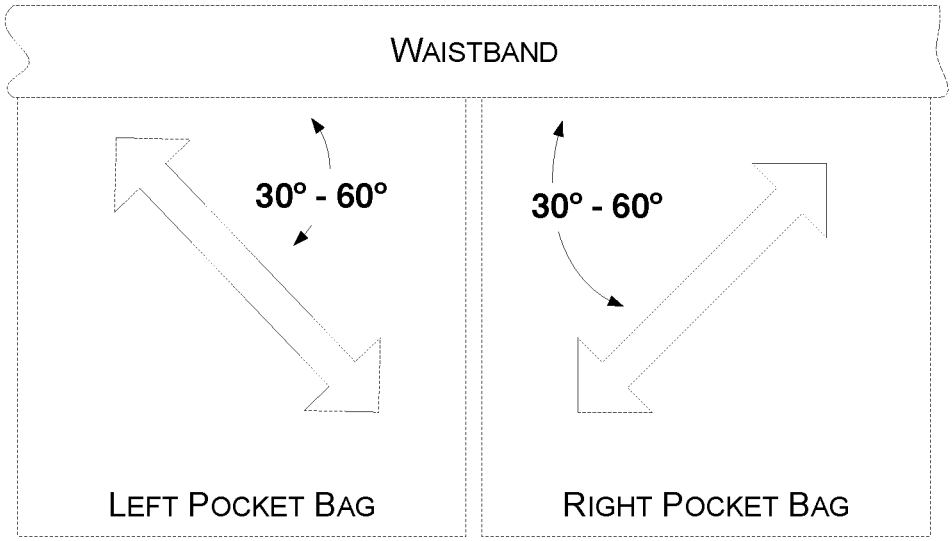
Figure 3K:
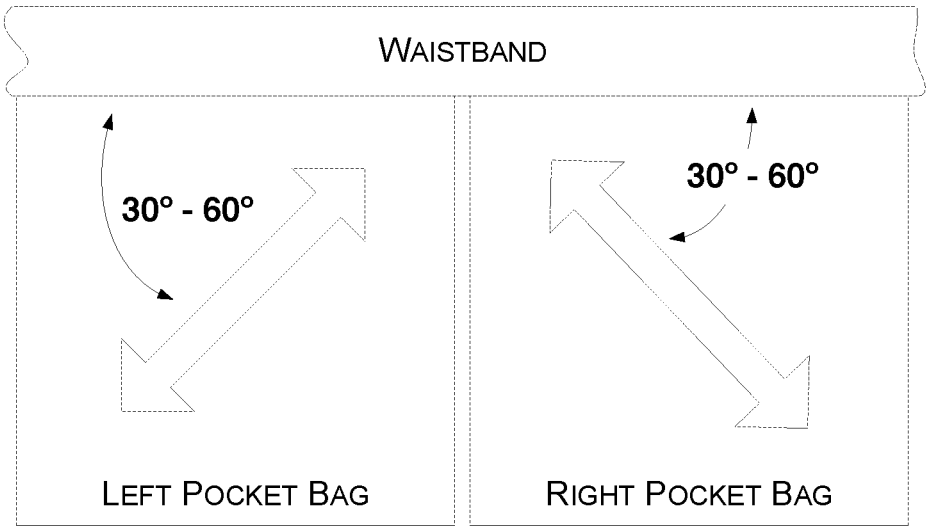
Figure 3N:
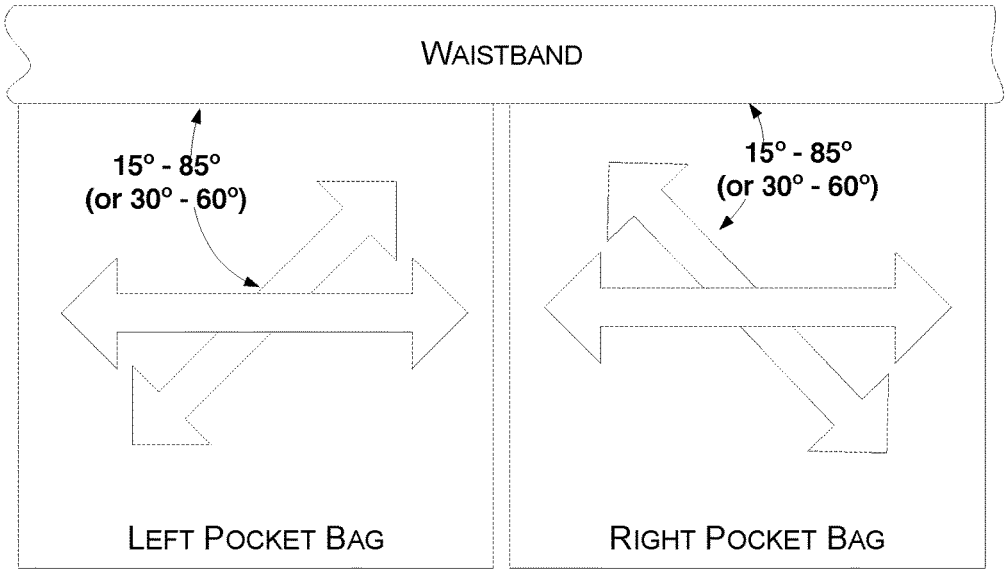
Figure 4:
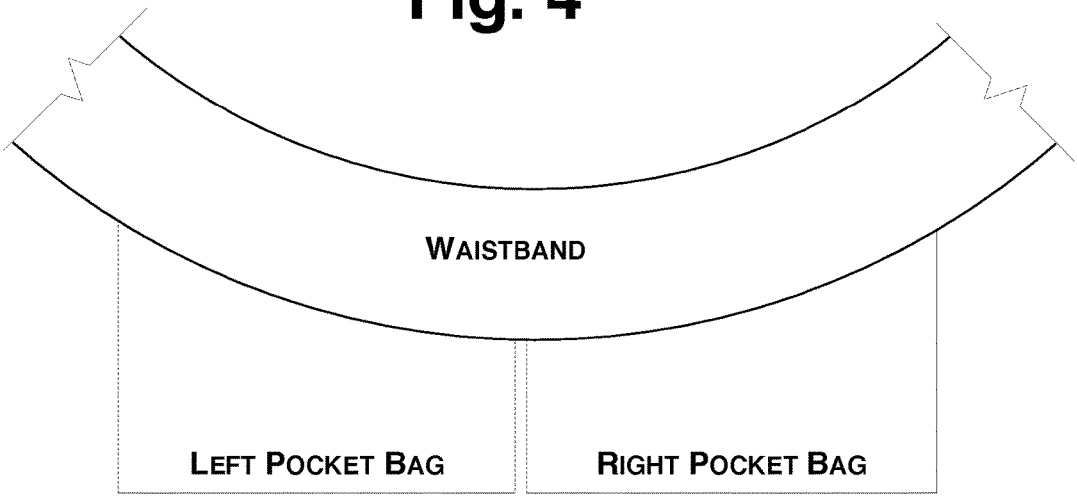
FIG. 4 shows aspects of abdomen control pockets attached to a curved waistband according to exemplary embodiments hereof.

When both the inner and outer portions of the pocket bag are formed using a fused fabric composite material, a direction of the stretch and recovery of both the inner and outer portions may be, but need not be, in the same direction (e.g., left-to-right, parallel to the waistband). For example, as shown in FIG. 3(E)-3(G), the inner and outer portions may be in different directions. It should be appreciated that providing stretch and recovery in the vertical (top to bottom) direction is least desirable.

When only one of the inner and outer parts of the pocket bag is formed using a fused fabric composite material, preferably the fused fabric is used for the outer part. In this manner the fabric of the pocket bag that will contact the wearer's skin (i.e., the inner fabric) will be more comfortable than a fused fabric composite.

Thus, preferably when a fusible is used to form a composite fabric, preferably the pocket bag or lining will be constructed and attached to the outer garment with the fusible facing the fabric of the garment (e.g., pants) and/or into the pocket so that the wearer's skin will only touch cotton that will be cool and dry and absorbent. So, e.g., if one fabric is composite (e.g., fusible and cotton) then preferably the cotton faces the user's skin and the composite fabric faces the garment. If the pocket is formed from two composite fabrics (e.g., both with fusible and cotton) then the pocket is formed so that the fabric (the inner) facing and potentially touching the wearer's skin will be the cotton (i.e., the side of the composite fabric without the fusible). In that case the side with the fusible will face away from the user and towards the outer garment.

The outer garment may be formed of any material, including: denim, cotton, cotton blends, wool, wool blends, polyester, polyester blends, spandex, spandex blend, polyester viscose, linen, and linen blend.

The outer garment may be or comprise trousers (short or long), skirts, or the like.

The fused fabric composite material comprises a fusible and a base fabric. The base fabric may be or comprise any fabric, including cotton, cotton blend, etc. In preferred embodiments hereof the base fabric is one such as cotton that will be comfortable (e.g., cool, dry, and absorbent) when against a wearer's skin.

A fused fabric composite (e.g., with a fusible material or interlining applied to a base fabric) is an example of a multilayer material (one layer comprising the base fabric and the other layer comprising the fusible or interlining material).

The Waistband

Although any kind of waistband may be used on the outer garment, in preferred embodiments hereof the waistband is a curved waistband formed, e.g., from a waistband fabric having outer portions more extensible than the center section thereof. This waistband fabric may be provided to a sewing machine through a folder such that the folder is angled to a sewing zone to force the outer sections of the waistband strip to proceed faster than the central section resulting in a curve being formed during attachment to the garment. A curved waistband may be formed in any manner. One exemplary manner is described in U.S. Pat. No. 7,506,597, the entire contents of which are hereby fully incorporated herein by reference for all purposes.

EXAMPLES

Example 1

A pocket bag is formed form a first fused fabric composite material and a second non-composite fabric. The first fused fabric composite has stretch and recovery properties in one direction. The pocket bag is attached to an outer garment, e.g., as described above.

Example 1.1

The pocket bag of Example 1 is attached to the outer garment with the stretch direction being substantially parallel to the waistband of the outer garment.

Example 1.2

The pocket bag of Example 1 is attached to the outer garment with the stretch direction being at an angle of between about 15° and 85°, preferably about 30° and 60°, to the waistband of the outer garment.

Example 1.3

Same as example 1.1 or 1.2 with the fused fabric composite being used as the outer piece of the pocket bag and the second non-composite fabric as the inner piece.

Example 1.4

Same as example 1.1 or 1.2 with the fused fabric composite being used as the inner piece of the pocket bag and the second non-composite fabric as the outer piece.

Example 2

A pocket bag is formed form a first fused fabric composite material and a second non-composite fabric. The first fused fabric composite has stretch and recovery properties in two directions. The pocket bag is attached to an outer garment, e.g., as described above.

Example 2.1

The pocket bag of Example 2 is attached to the outer garment with at least one stretch direction being substantially parallel to the waistband of the outer garment.

Example 2.2

The pocket bag of Example 2 is attached to the outer garment with at least one stretch direction being between at an angle of between about 15° and 85°, preferably between about 30° and 60°, to the waistband of the outer garment.

Example 2.3

Same as example 1.1 or 1.2 with the fused fabric composite being used as the outer piece of the pocket bag and the second non-composite fabric being used as the inner piece of the pocket bag.

Example 2.4

Same as example 1.1 or 1.2 with the fused fabric composite being used as the inner piece of the pocket bag and the second non-composite fabric being used as the outer piece of the pocket bag.

Example 3

A pocket bag is formed form a first fused fabric composite material and a second fused composite fabric. The first fused fabric composite has stretch and recovery properties in at least one direction and the second fused composite has stretch and recovery properties in at least one direction. The pocket bag is attached to an outer garment, e.g., as described above.

Example 3.1

The pocket bag of Example 3 is formed such that a stretch direction of the first fused composite fabric is substantially the same as a stretch direction of the second fused composite fabric.

Example 3.2

The pocket bag of Example 3 is formed such that a stretch direction of the first fused composite fabric is substantially perpendicular to a stretch direction of the second fused composite fabric.

Example 3.3

The pocket bag of Example 3 is formed such that the a stretch direction of the first fused composite fabric is at an angle of between about 15° and 85°, preferably about 30° and 60°, to a stretch direction of the second fused composite fabric.

Example 3.4

The pocket bag of any one of Examples 3.1 to 3.3 wherein one of the fused composite materials has stretch and recovery in two directions and the other fused composite material has stretch and recover in only one direction.

Example 3.5

The pocket bag of any one of Examples 3.1 to 3.3 wherein both of the fused composite materials have stretch and recovery in two directions.

Example 4

A garment formed with one or more pocket bags according to any of the previous examples (1, 1.1-1.4, 2, 2.1-2.4, 3, 3.1-3.5).

Example 5

A garment formed according to any of the previous examples (1, 1.1-1.4, 2, 2.1-2.4, 3, 3.1-3.5, 4) where the waistband is a curved waistband.

It should be appreciated that these examples are provided to show some, but not all, variations of the combinations that may form the pocket bags. Those of ordinary skill in the art will realize and appreciate, upon reading this description, that pocket bags may be formed with either or both the inner and outer portions being a fused composite material. The inner and outer portions may have stretch and recovery properties in one or two directions. The pocket bags may be formed with the stretch/recovery properties of the inner and outer portions being in the same or different directions with respect to each other and/or the to the waistband of the outer garment.

While some examples describe a single pocket bag, those of ordinary skill in the art will realize and appreciate, upon reading this description, that a typical garment will use two preferably substantially symmetric pocket bags (e.g., as shown in FIG. 2(B)).

Thus are described control-top garments and methods of making same.

Where a process is described herein, those of ordinary skill in the art will appreciate that the process may operate without any user intervention. In another embodiment, the process includes some human intervention (e.g., a step is performed by or with the assistance of a human).

As used in this description, the term "portion" means some or all. So, for example, "A portion of X" may include some of "X" or all of "X". In the context of a conversation, the term "portion" means some or all of the conversation.

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first" and "second" in the description and claims are used to distinguish or identify, and not to show a serial or numerical limitation. Similarly, the use of letter or numerical labels (such as "(a)", "(b)", and the like) are used to help distinguish and/or identify, and not to show any serial or numerical limitation or ordering.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A garment comprising:

a left pocket bag and a right pocket bag, each attached to the garment, each pocket bag formed from a first material and a second material, the first material having stretch and recovery properties in at least one direction thereof, and the second material having stretch properties in at least one direction thereof, wherein the left pocket bag is attached to said garment by: (a) attaching a first side edge portion of said left pocket bag to a left side of said garment; and (b) attaching a second side edge portion of said left pocket bag adjacent a front center of said garment, and wherein the right pocket bag is attached to said garment by: (c) attaching a first side edge portion of said right pocket bag to a right side of said garment; and (d) attaching a second side edge portion of said right pocket bag adjacent said front center of said garment.

2. The garment of claim 1, wherein the garment comprises a garment material, and wherein an outer piece comprising the first material is against the garment material.

3. The garment of claim 2, wherein, when the garment is worn, an inner piece comprising the second material is inside the garment.

4. The garment of claim 3 wherein said second material comprises a cotton or cotton blend fabric.

5. The garment of claim 1, wherein the first material comprises a first composite material.

6. The garment of claim 5, wherein the first composite material comprises: (i) a first base fabric, and (ii) a first fusible or an interlining.

7. The garment of claim 6, wherein the first base fabric and the first fusible are fused to form said first composite material.

8. The garment of claim 6, wherein the first composite material comprises said interlining fused to said first base fabric.

9. The garment of claim 5, wherein the first composite material has stretch and recovery properties in two directions thereof.

10. The garment of claim 5, wherein said first material comprises a first multilayer material.

11. The garment of claim 1, wherein the second material comprises a second composite material.

12. The garment of claim 11, wherein the second composite material comprises: (i) a second base fabric, and (ii) a second fusible or an interlining.

13. The garment of claim 12, wherein the second base fabric and the second fusible are fused to form said second composite material.

14. The garment of claim 12, wherein the second composite material comprises said interlining applied to said second base fabric.

15. The garment of claim 12, wherein the first material comprises: (i) a first base fabric, and (ii) a first fusible or an interlining, and wherein the first base fabric is distinct from the second base fabric.

16. The garment of claim 11, wherein said second material comprises a second multilayer material.

17. The garment of claim 11, wherein the second composite material has stretch and recovery properties in two directions thereof.

18. The garment of claim 1, wherein each pocket bag is further attached to said garment by: (c) attaching a portion of each said pocket bag to a waistband of said garment.

19. The garment of claim 16, wherein the first material has stretch and recovery properties in two directions thereof.

20. The garment of claim 1, wherein said second material also has recovery in said at least one direction thereof.

21. The garment of claim 1, wherein each said pocket bag is attached to the garment with a stretch direction of the first material being substantially parallel to a waistband of the garment.

22. The garment of claim 21, wherein said stretch and recovery properties of said first material are greater in a primary stretch direction than in other directions thereof, and wherein each said pocket bag is attached to the garment with said primary stretch direction of the first material being substantially parallel to a waistband of the garment.

23. The garment of claim 1, wherein each said pocket bag is attached to the garment with a stretch direction of the first material being at an angle of between about 15° and 85° to a waistband of the garment.

24. The garment of claim 1, wherein each said pocket bag is attached to the garment with a stretch direction of the first material being at an angle of between about 30° and 60° to a waistband of the garment.

25. The garment of claim 13, wherein the garment has a curved waistband.

26. The garment of claim 1 wherein the garment comprises one of: long trousers, short trousers, and a skirt.

27. The garment of claim 1, formed from a material comprising: denim, cotton, cotton blends, wool, wool blends, polyester, polyester blends, spandex, spandex blend, polyester viscose, linen, and linen blend.

28. Trousers comprising:

a left leg, a right leg; and a left pocket bag and a right pocket bag, each pocket bag attached to said trousers by: (a) attaching a first side edge portion of each said pocket bag to a corresponding side of said trousers, wherein each said pocket bag is formed from a first material and a second material, the first material having stretch and recovery properties in at least one direction thereof, and the second material having stretch properties in at least one direction thereof.

29. The trousers of claim 28, wherein each said pocket bag is further attached to said trousers by (b) attaching a second side edge portion of each said pocket bag adjacent a front center of said trousers.

30. The trousers of claim 29, wherein the left pocket bag and the right pocket bag are combined.

31. The trousers of claim 28, wherein said trousers does not have a front fly or zipper portion.

32. The trousers of claim 28, wherein each said pocket bag is further attached to said trousers by (b) attaching a second side edge portion of each said pocket bag adjacent a connector of said trousers.

33. The trousers of claim 32, wherein said connector comprises a zipper.

34. The trousers of claim 32, wherein each pocket bag is further attached to said trousers by: (c) attaching a portion of each said pocket bag to a waistband of said trousers.

35. The trousers of claim 28, wherein the trousers comprises one of: long trousers and short trousers.

36. The trousers of claim 28, formed from a material comprising: denim, cotton, cotton blends, wool, wool blends, polyester, polyester blends, spandex, spandex blend, polyester viscose, linen, and linen blend.

37. The garment of claim 1, wherein the garment comprises a connector at said front center of said garment, and wherein the second side edge portion of the left pocket bag is attached on a left side of the connector, and wherein the second side edge portion of the right pocket bag is attached on a right side of said connector.

38. The garment of claim 37, wherein said connector comprises a zipper or fly.

39. A garment comprising:

a piece comprising a left pocket bag and a right pocket bag, each pocket bag formed from a first material having stretch and recovery properties in at least one direction thereof, and a second material having stretch properties in at least one direction thereof, wherein the piece is attached to said garment by attaching: (a) a left side edge portion of said piece to a left side of said garment; and (b) a right side edge portion of said piece to a right side of said garment; and (c) a top portion of said piece to a waistband of said garment.

40. The garment of claim 39, wherein the first material is a first composite material comprising a base fabric, fused with a fusible or an interlining.

* * * * *